United States Patent [19]

Grothoff

[11] Patent Number: 4,615,465

[45] Date of Patent: Oct. 7, 1986

[54] ATOMIZING PUMP FOR WATER SOLUTIONS

[76] Inventor: Hans Grothoff, Pulverstrasse 35, 4600 Dortmund 50, Fed. Rep. of Germany

[21] Appl. No.: 462,934

[22] Filed: Jan. 31, 1983

[30] Foreign Application Priority Data

Feb. 8, 1982 [DE] Fed. Rep. of Germany ..... 3204257

[51] Int. Cl.[4] ..... B05B 11/02

[52] U.S. Cl. ..... 222/1; 222/190; 222/192; 222/321; 29/458; 29/460; 239/331

[58] Field of Search ..... 222/190, 192, 321, 1, 222/383, 385; 184/28; 239/331, 333; 29/458, 460; 53/141, 474

[56] References Cited

U.S. PATENT DOCUMENTS 3,991,914 11/1976 Kotuby et al. ..... 222/321

OTHER PUBLICATIONS

*McCutcheon's Detergents & Emulsifiers,* 1973 North American Edition, Allured Publishing Corp., Ridgewood, N.J. pp. 58–60.

*Primary Examiner*—Joseph J. Rolla
*Assistant Examiner*—Frederick R. Handren
*Attorney, Agent, or Firm*—Michael J. Striker

[57] ABSTRACT

In an atomizing pump for dosed atomization and application of water solutions a boundary-surface-active composition from the class of surfactant is provided in an inner chamber at least during operation of the pump. The boundary-surface-active composition can be supplied into the inner chamber between inlet and outlet valves and/or located upstream of the inlet valve and introduced into the inner chamber during first working strokes in more concentrated form than the solution to be atomized.

25 Claims, 3 Drawing Figures

ATOMIZING PUMP FOR WATER SOLUTIONS

BACKGROUND OF THE INVENTION

The present invention relates to an atomizing pump especially for water solutions, as well as to a method of manufacturing the same. Such pumps are utilized in cosmetics and pharmaceutic fields for dosed atomization and application of liquid preparations.

Atomizing pumps which are presently used are of different constructions. All these constructions have a common characteristic feature which includes a pressure chamber provided inside a stationary cylinder and having a variable volume by a longitudinally displaceable piston. The piston seals the pressure chamber at the cylinder wall by at least one sealing sleeve lip. It performs a predetermined by design, reproducible displacement stroke and is automatically returned to its initial position by a pressure spring. The pressure chamber is limited at the aspiration side by an inlet valve which operates automatically during pressure application or forcibly in dependence upon the pressure stroke. At the outlet side the pressure chamber is limited by an outlet valve which operates in dependence upon pressure or path and is arranged in the region of the piston or in a subsequent structural part. An extraction head is located after the outlet valve and is connected by a hollow piston shaft with the pressure chamber. In dependence upon its construction, the extraction head atomizes the fluid. A riser pipe is connected with the inlet valve and extends inwardly to a bottom of the container. Withdrawal of the liquid is performed by application of pressure to the piston via the extraction head in such a way that the inlet valve closes, the outlet valve opens, and the liquid with a downward displacement of the piston is discharged until the end position is attained. During return displacement of the piston with the closed outlet valve, the pressure chamber is again filled with liquid via the opened inlet valve. An advantageous construction of this pump is the pressure atomizing pump in which the opening of the outlet valve is performed first with formation of a predetermined minimum liquid pressure in the pressure chamber of usually approximately 5 bar, whereby a positive uniform atomization substantially independent from the actuating force is produced.

The above described atomizing pumps are manufactured in great quantities as mass articles and composed, with the exception of the pressure spring and eventually a ball, exclusively of synthetic plastic parts. These parts are produced by injection molding in a multiple tools from thermoplastic synthetic plastic materials and assembled in subsequent working steps by assembling automatic machines to an end product. A relatively great tolerance play is required in such a mass production. This play is compensated for in the sealing region between the cylinder and the piston in that the provided sealing lip of the piston is oversized relative to the maximum possible inner diameter of the cylinder. The already unfavorable friction coefficient of the plastic parts relative to one another is increased by the oversize which increases the prestress. Thereby actuation of the pump with a possible actuation force, as well as automatic return stroke of the piston to the initial position, are not possible without an additional lubrication of the mutually sliding surfaces. Because of this, during mounting of the pump, the plastic parts are supplied with a small quantity of lubricating medium which reduces the adherence and friction. Particularly silicon oil is used for this purpose since, in addition to physiological acceptability and good creep properties, it is suitable because the formed lubrication film is both mechanically and chemically resistant and is not released by the atomizing liquid from the sliding surfaces. It is retained during the atomization of great liquid quantities to the full emptying of the pack and thereby operational failures of the pump, for example by seized piston, are prevented. Similarly to the synthetic plastic parts formed mainly on polyolefin basis, the silicon oil also exhibits essential hydrophobic properties. These hydrophobic properties in the event of atomization of non-water solutions do not lead to the disadvantageous phenomena or operational failures. However, during atomization of water solutions this leads to the fact that in inoperative condition air originally present in the pump is driven out slowly and not completely and is replaced by the liquid, since the air partially deposits on the inner surfaces of the pump in form of small bubbles. The air bubbles located inside the pressure chamber of the pump are compressed during operation of the pump and the pressure increase in the respective interior of the pump chamber connected therewith, reduce their volume and lead to an idle stroke which is not a fluid output and is increased as compared with the normal idle stroke. Therefore, simultaneously a decrease of the output relative to the nominal output takes place.

During the return stroke of the pump piston, the air bubbles expand and thereby reduce the aspiration quantity of the pump. The thus produced deviation from the proper nominal output is not constant from stroke to stroke or from pump to pump, but instead varies in a wide range with differences of the order of approximately 50%. After a high number of strokes, for example at most more than 100 strokes, the air portion is removed from the pump so that the effective output can be equal to the nominal output in sufficient value. However, in many cases air collected prior to the inlet valve is released from there and travels into the pressure chamber and to again reduce the output. Such an uncontrolled condition is not tolerable in the case of utilization of the pump in pharmaceutical field, where it is necessary to provide constantly accurate output which is constant from stroke to stroke.

SUMMARY OF THE INVENTION

Accordingly, it is an object of the present invention to provide an automatic pump for dosed atomization and application of water solutions, and a method of manufacturing the same, which avoids the disadvantages of the prior art.

More particularly, it is an object of the present invention to provide an atomizing pump and a method of manufacturing the same, which improve the dosing accuracy and constancy of the output for an atomizing pump and particularly a pressure atomizing pump during the utilization of water solutions and equalize the favorable conditions of non-water solutions in such a way, that the non-atomized air located in the inner chamber of the pump is removed completely during the first working stroke and replaced by the liquid without residue. At the same time friction during the sliding of the mutually sliding pump parts is not increased relative to the prior-art constructions and simultaneously it is guaranteed that the action of a lubricant remains completely effective at least during the complete emptying of the container.

In accordance with the present invention these objects are attained in a surprising manner when a boundary-surface-active composition from the class of surfactants is provided in the inner chamber of the pump during its operation. More particularly, these objects are attained when the boundary-surface-active composition from the class of surfactants is located in the inner chamber of the cylinder between its inlet and outlet valves and/or the boundary-surface-active composition from the class of surfactants is in more concentrated form than the solution inside the inner chamber, and located upstream of the inlet valve so that during the first actuating strokes it is brought into the inner chamber.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

An atomizing pump for dosed atomization and application of water solutions has a cylinder, inlet and outlet valves, an inner chamber enclosed by the cylinder and extending between the inlet and outlet valves, and a boundary-surface-active composition from the class of surfactants provided in the inner chamber at least during operation of the pump.

Figure 3:
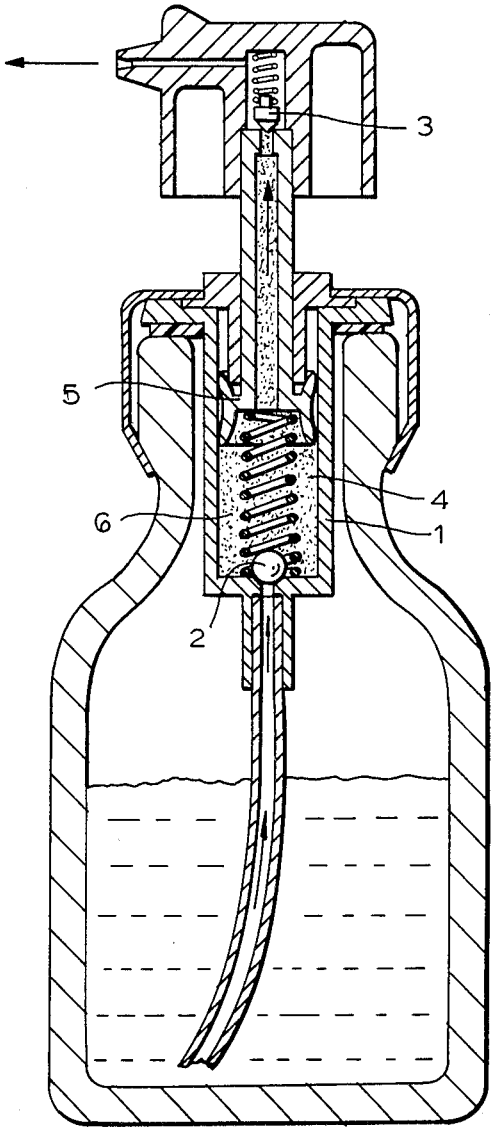

The above described atomizing pump is shown in FIG. 3. It is provided with a cylinder 1, inlet and outlet valves 2 and 3, an inlet chamber 4, and a piston 5. The above mentioned boundary-surface-active composition from the class of surfactants is identified with reference numeral 6.

The boundary-surface-active composition from the class of surfactants is located in the inner chamber enclosed by the cylinder between the inlet and outlet valves, and/or is available in more concentrated form than the solution to be atomized, upstream of the inlet valve so that during first working strokes it is brought into the inner chamber.

For guaranteeing an optimal efficiency, it is necessary to provide that the surfactant is present in liquid or pasty form, forms a mechanically stable protective layer with high affinity to the synthetic plastic surfaces, and is boundary-surface-active to a sufficient degree on the boundary surface to the water solution, so as to guarantee a good wetting of surfaces which are in contact with the solution, without however requiring fast dissolving and washing off by the water solution so that it remains available until a complete emptying of the container takes place.

In general, boundary-surface-active compositions from different groups of surfactants can be equally well utilized with efficiency; it has been found that it is especially advantageous when the boundary-surface-active compositions from the group of non-ionogenic surfactants are used. This is because the materials of this group are produced in a wide range in required highly concentrated, liquid or pasty form with simultaneous physiological acceptability. They are substantially reaction- and ion-neutral to the base materials and solutions which are used in pharmaceutic fields, and thereby a universal utilization of such atomizing pumps is ensured.

For the case when the surfactant must perform a double function, in that in addition to the fast removal of the air particles it must simultaneously serve as a lubricant up to a full emptying of the container, the selection of the surfactant or surfactant mixture is difficult and expensive and requires the respective acceptibility researches in order to determine the solution ratio of the surfactant to the solution to be atomized and the packing dimension. On the ground of the universal utilization with at least equal efficiency, it has been found advantageous when, in addition to the boundary-surface-active composition, an additional adhesive-and sliding friction reducing water-insoluble material is available in the inner chamber of the atomizing pump or is brought into the inner chamber during first working strokes. The surfactant takes care of the fast washing out of the air particles from the inner chamber of the pump, whereas the water-insoluble material remains also after complete dissolution and removal of the surfactant in the inner chamber of the pump and acts as a lubricant.

Especially good results are obtained when this material belongs to the composition class of silicones. They have proven not to be emulsified by the surfactants and removed with them completely from the innqr chamber of the pump, but they remain in the inner chamber in sufficient amount up to the emptying of the container.

The atomizing pump in accordance with the present invention is manufactured by an inventive method which includes several embodiments. An especially good efficiency of the boundary-surface-active composition is provided when this composition, and in some cases the water-insoluble material acting as a lubricant, is applied prior to or during the assembly of the pump on the parts which form and limit the inner chamber of the atomizing pump and are later in contact with the solution to be atomized.

For ensuring a uniform distribution it is advantageous when the boundary-surface-active composition and the adhesive- and sliding-friction-reducing material are applied to respective surfaces of the individual parts of the pump either one after the other in a predetermined sequence or mixed in form of a dispersion, during atomization.

In many cases a sufficient effectiveness of the boundary-active compositions is provided only when they are first introduced after the assembly of the pump and in some cases prior to or during the assembly of the pumps into the inner chamber provided with the water-insoluble lubricants.

Moreover, a certain quantity of the boundary-surface-active composition alone or in some cases in mixture with the water-insoluble lubricant in concentrated form can be added in the inner chamber of the pump. This can be performed by a dosing device with a closed tubular needle which extends through a riser pipe of the pump into the inner chamber.

For the case when the atomizing pumps are tested individually for orderly function, which is particularly required in pharmaceutic field, it is advantageous that an additional working step as compared to the above mentioned methods can be eliminated, when the boundary-surface-active composition is applied by spraying of the pump with a solution and subsequent evaporation of the solvent by placing the pump which is at least partially filled with the solution,in vacuum.

In accordance with a further feature of the inventive method, a certain quantity of the boundary-surface-active composition alone or in mixture with the water-insoluble lubricant in concentrated form is introduced upstream of the inlet valve of the pump in the flow path of the liquid to be atomized, either during the mounting or after the latter. This can be performed, for example, in that the composition is introduced into an inner opening of the riser pipe, or a reservoir filled with the composition is arranged in the pump and the riser pipe or on the riser pipe itself.

The superior efficiency of the atomizing pump for water solutions provided in accordance with the present invention with the boundary-surface-active composition, as compared with structurally similar pumps which however are provided only with a lubricant, is illustated in the tests described below and accompanied by FIGS. 1 and 2.

TEST 1

(Prior Art)

The test was conducted with conventional pressure atomizing pumps manufactured by "Calmar-Albert," type Mark II, which is identical to the construction disclosed in U.S. Pat. No. 4,051,983, and has a predetermined nominal output of 100 microliters per working stroke. During preparation, the individual parts of the pump which will subsequently be in contact with the fluid to be atomized, such as the cylinder inner chamber, piston, pressure spring, inlet and outlet valves (servo piston), are sprayed prior to assembly on respective contact surfaces by a pressure air atomizer with a silicone oil, trade name Baysilon M 300 in a fine and uniform manner. The entire quantity of silicone oil applied per pump amounts to between 3 and 5 mg.

After the assembly of the pump and during its completing with additional parts such as an atomizing head, riser pipe and sealing ring, they are screwed on bottles filled with distilled water and actuated individually by hand. The quantity of water produced per pump stroke is determined by the weight loss of the bottle. In this manner three pumps with respective 100 working strokes have been tested. The initial strokes have not been evaluated and counted as working strokes unless with no actuation the actual output amounts to at least 30% of the nominal output. For exceeding this limiting value, at least 5 and 7, average 6 working strokes per pump are needed. The obtained individual results were combined, the percentage portions of the individual values were obtained and graphically shown in FIG. 1 in form of a frequency diagram.

TEST 2

(In accordance with the present invention)

This test is conducted in the same manner as the Test 1. Identical pump parts were used and also three pumps were manufactured and tested. In contrast tothe first test, the structural parts of the pumps used for Test 2 were treated by a dispersion of 5 weight-% of a boundary-surface-active polyol fatty acid ester (trade name Cetiol HE) and 95 weight-% silicone oil Baysilon M 300. This dispersion was produced by intensive mixing and sufficiently stable for several hours.

The output quantity ofat least 30% of the nominal output were attained by 3–5, average 4 working strokes. The obtained individual results were similarly evaluated as in Test 1 and graphically illustrated in FIG. 2.

Figure 1:
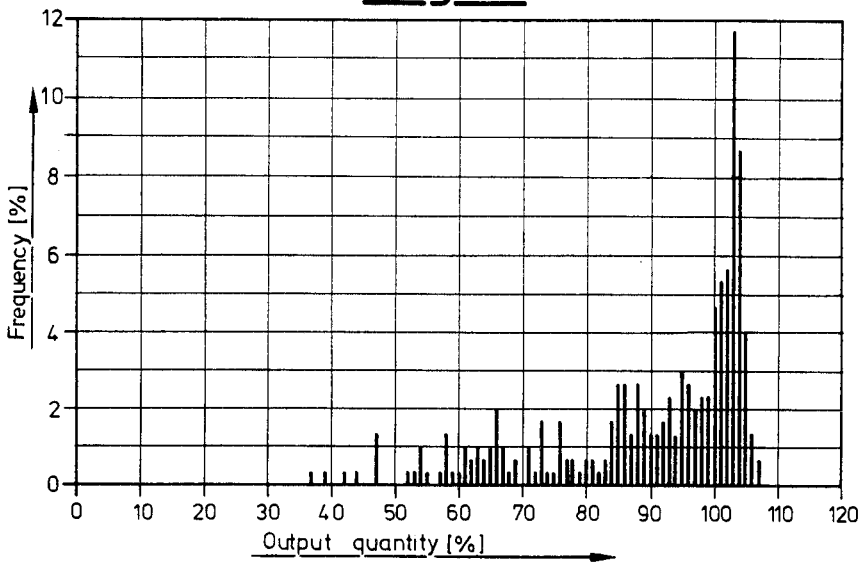
FIG. 1 is a view illustrating the efficiency of an atomizing pump in accordance with the prior art.
Figure 2:
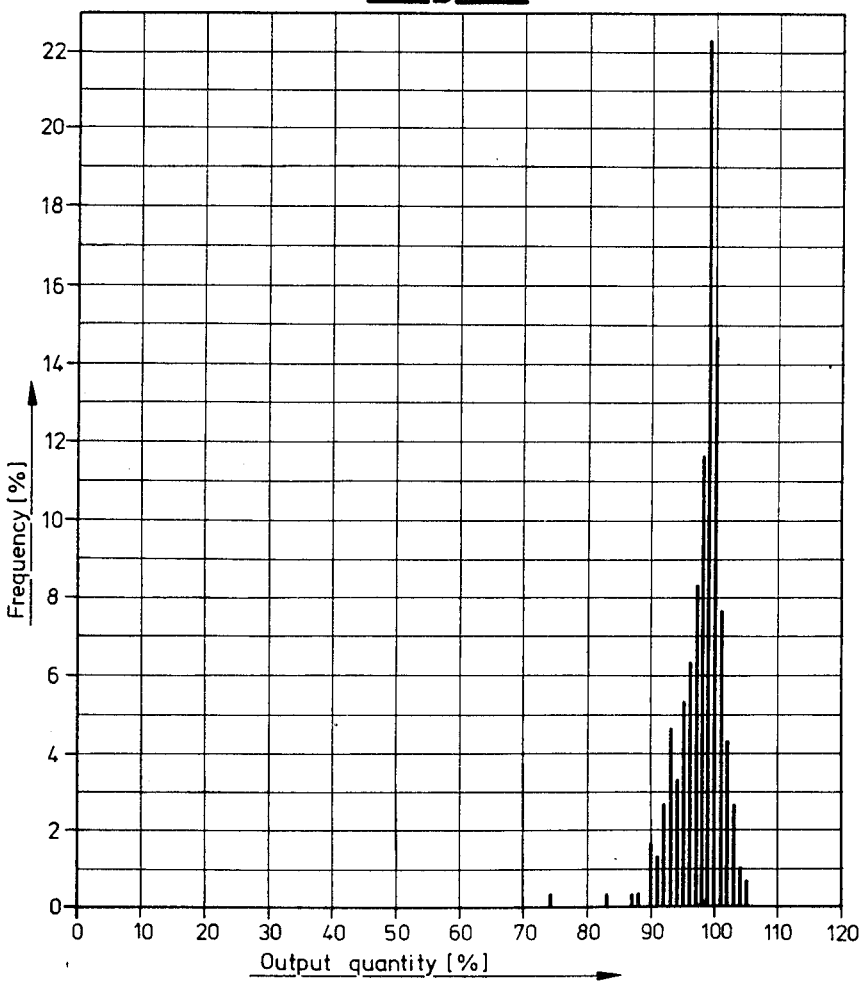
FIG. 2 is a view illustrating the efficiency of an atomizing pump in accordance with the present invention and FIG. 3 is a view showing the atomizing pump in accordance with the present invention.

A comparison of the results of both tests illustrated in FIGS. 1 and 2 clearly shows that in the event of introduction of the boundary-surface-active composition also in the case of water solutions the dosing accuracy of the atomizing pumps is considerably improved as compared with the prior-art pumps. When in accordance with the requirements of the pharmaceutic industry a tolerance range for the individual output is set of ±10% of the nominal output, then with the utilization of the inventive boundary-surface-active composition (Test 2) only 1.32% of the individual value is located outside the tolerance range of 90–110 μl, whereas in Test 1 37.7% of all obtained values are located outside this tolerance range. Also the average value of the output counted from all obtained individual values lies in Test 1 with 89.9 μl considerably lower than in Test 2 with 97.8 μl.

The results of the above described tests show further a favorable influence of the boundary-surface-active compositions on the number of working strokes required for a valuable output. While the pump provided with a lubricant in accordance with the prior art in the Test 1 needs for exceeding the limit of 30% of the nominal output an average of 6 working strokes, the pump with the utilization of the inventive boundary-surface-active composition in the Test 2 needs only 4 working strokes as an average. Favorable results in the case of the utilization of the boundary-surface-active composition make it possible to conclude that in addition to the complete air removal, it leads moreover to a faster removal of the air particles from the inner chamber of the pump, than in the case of the utilization of lubricant in accordance with the prior art.

Further tests conducted with market-available pharmaceutic preparations show that the inventive presence of the boundary-surface-active composition in the inner chamber of the pump has also the advantage when these substances are contained in the water liquid to be atomized in conventional relatively small concentration in accordance with prescriptions. In the case of these preparations, the results of the pumps which are provided only with a lubricant in accordance with the prior art in the sense of the portion of the individual outputs outside of the tolerance region is better than in the above shown Test 1 with pure water. However, these results do not meet the requirements of the industry and do not reach close the value which can be obtained by the utilization of the boundary-surface-active compositions in the pumps. These findings showed that for a complete and fast removal of the air particles from the inner chamber of the pump it is required to have available or to introduce the boundary-surface-active composition during the aspiration step in possibly high concentration. The solution to provide a sufficient improvement by increase of the concentration of the boundary-surface-active composition in the solution to be atomized, also in the pumps provided only with lubricant in accordance with the prior art, is not acceptable in practice. This is because, on the one hand, this changes the preparation in unacceptable manner and, on the other hand, can negatively influence the action of the preparation, and finally the boundary-surface-active composition can lead to side effects of the preparation.

The inventive solution in accordance with which the boundary-surface-active composition is arranged inside the pump does not interfere, however, with the composition and action of the preparations. As can be clearly seen from Test 2, the entire quantity of the boundary-surface-active composition per pump which is 0.2 mg is relatively very small. Further, the boundary-surface-active composition selected from the group of non-ionogenic compositions is generally good water-soluble, and thereby is washed out completely from the pump with aspiration strokes not used for the treatment. As shown from further tests, the water-insoluble material which has the proper sliding function in this case, such as for example silicone oil, is not washed out during first working strokes from the inner chamber of the pump as the boundary-surface-active composition, but instead remains in a sufficient quantity on the outer surfaces of the synthetic plastic parts being bonded and is active to reduce sliding until full emptying of the container. Therefore such pumps have, in the sense of the actuation force and other properties determined by the lubricant, completely the same values and do not noticeably differ from the pumps which are provided with a lubricant in accordance with the prior art. This can be confirmed by a further test of the pumps from the Tests 1 and 2, when, after a greater water quantity has been atomized, the pumps are provided with new completely lubricant-free pistons with the same remaining parts and again tested as to function, actuation force and further criteria. Both pump types operate with the new pistons without recognizable difference unobjectionably and show no changes of previous conditions with the exchanged lubricant-treated pistons. It has been thereby proven that also in the case of the utilization of the boundary-surface-active composition in addition to the water-insoluble conventional lubricant and the complete washing out of the boundary-surface-active composition, the lubricant remains available in sufficient quantity on the cylinder wall surfaces, since otherwise from observation of the pumps assembled completely without lubricant, the new pistons will be so strongly stuck during the first actuation in the cylinder that they will no longer be moved back by the spring force to the initial position.

It is evident that the utilization of the inventive features is not limited to the type of atomizing pump. The boundary-surface-active composition can be used in general for improvement of the pump properties in the case of water solutions. The pump type used for tests is only exemplary, and the tests can be used also for all other known types.

The quantity of the boundary-surface-active composition applied to a pump, which is required for sufficient action, depends on several individual factors, such as a type of pump, a dosing quantity, a preparation to be atomized. This quantity cannot be universally fixed, but instead must be determined from case to case correspondingly. The same is true for the ratio of the boundary-surface-active composition in combination with the water-insoluble lubricant, so that no fixed ratio can be universally given.

It will be understood that each of the elements described above, or two or more together, may also find a useful application in other types of constructions differing from the types described above.

While the invention has been illustrated and described as embodied in an atomizing pump and a method of manufacturing the same, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An atomizing pump for dosed atomization and application of water solutions, comprising a cylinder; inlet and outlet valves; an inner chamber enclosed by said cylinder and extending between said inlet valve and said outlet valve; and a boundary-surface-active composition from the class of surfactants, provided in said inner chamber at least during operation of the pump with a surfactant in the composition being in more concentrated form than in the water solutions.

2. An atomizing pump as defined in claim 1, wherein said composition is located in said inner chamber prior to the operation of the pump.

3. An atomizing pump as defined in claim 1, wherein said boundary-surface-active composition is associated with the group of non-ionogenic surfactants.

4. An atomizing pump as defined in claim 1; and further comprising an additional adhesion- and sliding friction-reducing water-insoluble material provided in said inner chamber during the operation of the pump.

5. An atomizing pump as defined in claim 4, wherein said additional material is located in said inner chamber prior to the operation of the pump.

6. An atomizing pump as defined in claim 4, wherein said additional material is located upstream of said inlet valve and during first working strokes is introduced into said inner chamber.

7. An atomizing pump as defined in claim 4, wherein said additional material belongs to the class of silicones.

8. An atomizing pump for dosed atomization and application of water solutions, comprising a cylinder; inlet and outlet valves; an inner chamber enclosed by said cylinder and extending between said inlet valve and said outlet valve; and a boundary-surface-active composition from the class of surfactants, provided in said inner chamber at least during operation of the pump, a surfactant in the composition being in more concentrated form than in the water solutions, said composition being located upstream of said inlet valve so that during first working strokes it is introduced into said inner chamber.

9. An atomizing pump for dosed atomization and application of water solutions, comprising a cylinder; inlet and outlet valves; an inner chamber enclosed by said cylinder and extending between said inlet valve and said outlet valve; and a boundary-surface-active composition from the class of surfactants, provided in said inner chamber at least during operation of the pump, a surfactant in the composition being in more concentrated form than in the water solution, said composition being also located upstream of said inlet valve so that during first working strokes it is introduced into said inner chamber.

10. A method of manufacturing an atomizing pump for dosed atomization and application of water solutions, comprising the steps of providing a plurality of parts which limit an inner chamber and are in contact with a water solution to be atomized during operation of the pump; and applying at least during operation of the pump a boundary-surface-active composition from the class of surfactants, on said parts of the pump with a surfactant in the composition being in more concentrated form than in the water solutions.

11. A method as defined in claim 10; and further comprising the step of applying on said parts of the pump an additional water-insoluble material which serves as a lubricant.

12. A method as defined in claim 11; and further comprising the step of assembling the pump, said additional material applying step including applying the additional material prior to said assembling step.

13. A method as defined in claim 11; and further comprising the step of assembling the pump, said additional material applying step including applying the additional material during said assembling step.

14. A method as defined in claim 11, wherein said parts have surfaces, said composition applying and additional material applying steps including applying the composition and the additional material in a mixture with one another during atomization.

15. A method as defined in claim 13; and further comprising the step of assembling the pump, said additional material applying step including first applying the additional material before the assembling step, said composition applying step including applying the composition after the assembling step.

16. A method as defined in claim 11; and further comprising the step of assembling the pump, said additional material applying step including first applying the additional material during the assembling step, said composition applying step including applying the composition after the assembling step.

17. A method as defined in claim 11, wherein said composition applying step and said additional material applying step includes supplying the composition and the additional material into said inner chamber.

18. A method as defined in claim 11; and further comprising the step of assembling the pump, said providing step including providing an inlet valve in the pump, said composition applying and additional material applying steps including bringing the composition and the material upstream of the inlet valve in a flow path of the liquid to be atomized, after the assembling step.

19. A method of manufacturing an atomizing pump for dosed atomization and application of water solutions, comprising the steps of providing a plurality of parts which form an inner chamber and are in contact with a water solution to be atomized during operation of the pump; assembling the pump; and providing at least during operation of the pump a boundary-surface-active composition from the class of surfactants, on said parts of the pump by applying the composition prior to said assembling step of the pump.

20. A method of manufacturing an atomizing pump for dosed atomization and application of water solutions, comprising the steps of providing a a plurality of parts which form an inner chamber and are in contact with a water solution to be atomized during operation of the pump; assembling the pump; and providing at least during operation of the pump a boundary-surface-active composition from the class of surfactants, on said parts of the pump by applying the composition during said assembling step.

21. A method of manufacturing an atomizing pump for dosed atomization and application of water solutions, comprising the steps of providing a plurality of parts which form an inner chamber and are in contact with a water solution to be atomized during operation of the pump; and providing at least during operation of the pump a boundary-surface-active composition from the class of surfactants, on said parts of the pump by supplying composition into said inner chamber of the pump, the composition including a surfactant in more concentrated form than in the water solutions.

22. A method as defined in claim 21, wherein said supplying step includes spraying the pump with a solution of the composition and subsequently evaporating a solvent of the solution by placing into vacuum the pump which is at least partially filled with the solution.

23. A method of manufacturing an atomizing pump for dosed atomization and application of water solutions and having an inlet valve, the method comprising the steps of providing a plurality of parts which forms and limit an inner chamber and are in contact with a water solution to be atomized during operation of the pump; assembling the pump; and providing at least during operation of the pump a boundary-surface-active composition from the class of surfactants, on said parts of the pump by bringing the composition upstream of the inlet valve in a flow path of the liquid to be atomized, during the assembling step.

24. A method of manufacturing an atomizing pump for dosed atomization and application of water solutions and having an inlet valve, the method comprising the steps of providing a plurality of parts which form an inner chamber and are in contact with a water solution to be atomized during operation of the pump; assembling the pump; and providing at least during operation of the pump a boundary-surface-active composition from the class of surfactants, on said parts of the pump by bringing the composition upstream of the inlet valve in a flow path of the liquid to be atomized, after the assembling of the pump, the composition including a surfactant in more concentrated form than in the water solutions.

25. A method of manufacturing an atomizing pump for dosed atomization and application of water solutions and having an inlet valve, the method comprising the steps of providing a plurality of parts which forms and limit an inner chamber and are in contact with a water solution to be atomized during operation of the pump; assembling the pump; providing at least during operation of the pump a boundary-surface-active-composition from the class of surfactants, on said parts of the pump; and applying on said parts of the pump an additional water-insoluble material which serves as a lubricant, said composition applying and additional material applying including bringing the composition and the material upstream of the inlet valve in a flow path of the liquid to be atomized, during the assembling of the pump.

* * * * *